United States Patent [19]

Willach et al.

[11] Patent Number: 4,600,157

[45] Date of Patent: Jul. 15, 1986

[54] BOWL MILL

[75] Inventors: Rudolf Willach, Oberhausen; Günter Dibowski, Essen, both of Fed. Rep. of Germany

[73] Assignee: Deutsche Babcock Werke Aktiengesellschaft, Oberhausen, Fed. Rep. of Germany

[21] Appl. No.: 666,914

[22] Filed: Oct. 31, 1984

[30] Foreign Application Priority Data

Dec. 7, 1983 [DE] Fed. Rep. of Germany ..... 3344223

[51] Int. Cl.[4] ..... B02C 15/04

[52] U.S. Cl. ..... 241/59; 241/119

[58] Field of Search ..... 241/117–121, 241/60, 57, 52, 53, 59

[56] References Cited

U.S. PATENT DOCUMENTS 2,289,727 7/1942 Randolph ..... 241/59 X 3,951,347 4/1976 Tiggesbaumker et al. ..... 241/119 X

OTHER PUBLICATIONS

MPS Type Roller Mill for Grinding Bituminous Coal, Aufbereitungs-Technik, 12, pp. 537–549, 1971.

*Primary Examiner*—Mark Rosenbaum

*Attorney, Agent, or Firm*—Max Fogiel

[57] ABSTRACT

A bowl mill has a vertical mechanism to drive a milling bowl and a hot-air supply to an air box positioned below the bowl. An evacuator is positioned in the air box to prevent the box from overflowing when the mill shuts down suddenly. The evacuator has a drive mechanism that is separate from and independent of the mechanism that drives the mill.

20 Claims, 6 Drawing Figures

BOWL MILL

BACKGROUND OF THE INVENTION

The present invention relates to a bowl mill with a vertically powered milling bowl that milling cylinders roll over inside a milling space, which is surrounded by a housing, whereby there is an annular air box, which communicates with the milling space, below the milling bowl and whereby there is an outlet aperture in the floor of the air box and an evacuator extends through the air box.

The evacuator or stripper in a bowl mill of this type, known for example from *Aufbereitungstechnik* 12, 537–49 (1971), is rigidly attached to the driven milling-bowl support. The evacuator accordingly rotates at the same speed as the milling bowl. The function of the evacuator is to force coal dust and foreign bodies that get into the air box from the milling space out through the outlet aperture.

If the supply of hot air in a mill of this type is suddenly interrupted as the result for instance of a malfunction in the combustion space of the boiler supplied by the mill, the coal dust in the milling space at that particular moment will drop out of the milling bowl. Some of it will even get into the air box 8 and lead to malfunction in the equipment.

SUMMARY OF THE INVENTION

The object of the present invention is to improve the known bowl mill in such a way as to prevent coal dust from escaping when the equipment suddenly shuts down.

This object is attained in accordance with the invention in that the evacuator has a separate drive mechanism independent of the mechanism that drives the mill.

The evacuator can rotate more slowly than the milling bowl.

The evacuator can consist of two concentric rings with scrapers between them.

The scrapers can be positioned at least partly radially.

The radial section of the scrapers can be connected to the outer ring and can be approximately as long as the outlet aperture is wide, radially, and another section can connect to the radial distance at a tangent to the inner ring.

The rings can have recesses that open toward the lower edge, with tongues that bend outward positioned upstream of each recess with respect to the direction in which the evacuator rotates.

The evacuator can be suspended off the floor of the air box.

One or more suppressors can be positioned above the evacuator.

The evacuator can be a ring and the free ends of two adjacent scrapers can be connected.

The upper edge of one ring can have detent teeth that are engaged by a catch pin mounted on a catch that travels back and forth.

The catch can have a hydraulic drive mechanism.

The catch pin can pivot on the catch.

The catch pin can be positioned above the outlet aperture in the floor of the air box and the catch can travel over a distance that equals the width of the outlet aperture.

The catch pin can engage the free ends of the scrapers.

One or more wire brushes that touch the floor of the air box can be attached to the rings.

The evacuator can be provided with trailing chains.

The trailing chains can be attached to one of the scrapers, the links of the trailing chains can be connected together, and the outer links can be attached to the rings.

The trailing chains can be suspended from a support that is connected to the rings.

The rings can consist of connected segments and scrapers can be positioned at the points of contact between the segments and included into the joint between the segments.

A collar provided with detent teeth can be attached to the scrapers.

The device in accordance with the invention makes it possible to evacuate coal dust from the air box when the mill is down. On the one hand, adequate evacuation is ensured. On the other hand, enough milling material will remain in the milling bowl for sufficient combustible coal dust to be immediately blown into the firebox once the mill has been started up and charged with hot air.

Some preferred embodiments of the invention will now be described with reference to the attached drawings, wherein

DESCRIPTION OF THE PREFERRED EMBODIMENTS

Figure 1:
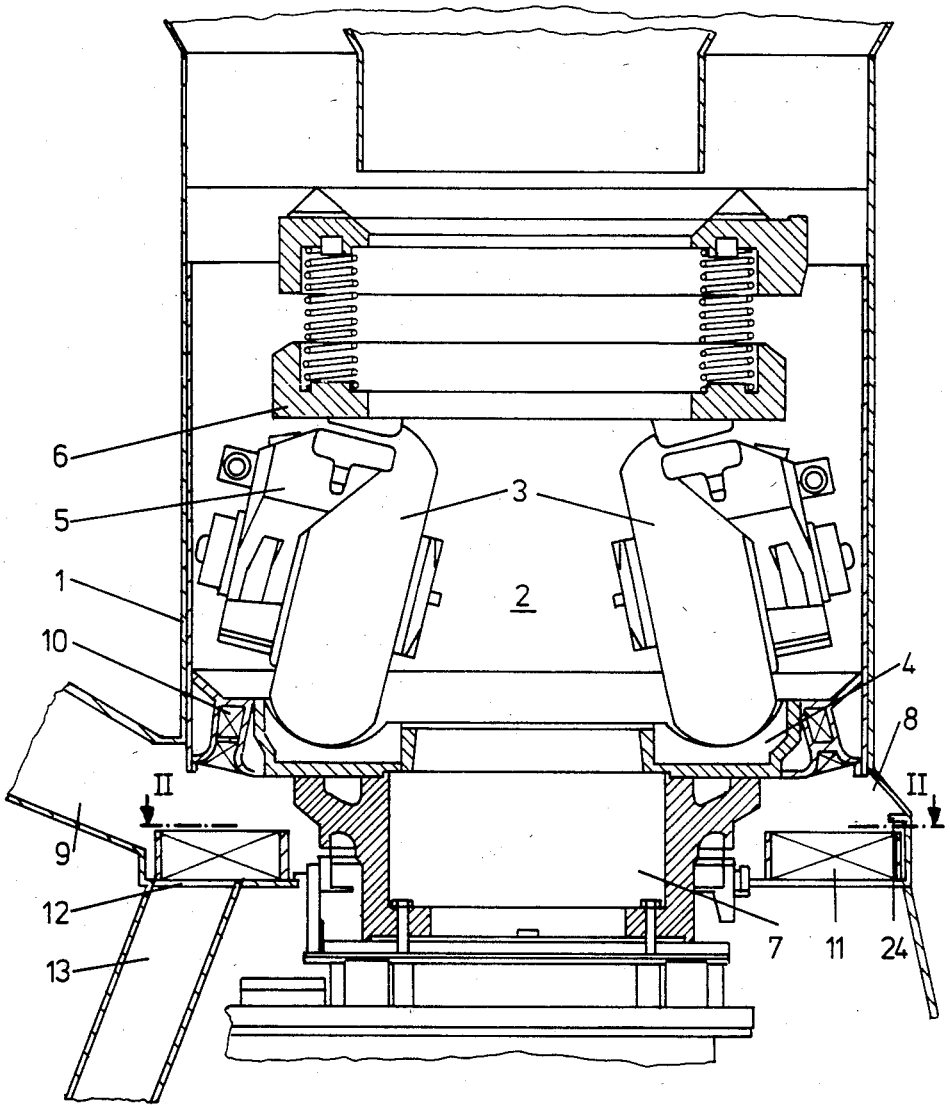
FIG. 1 is a longitudinal section through a bowl mill in accordance with the invention.

The bowl mill has a housing 1 that encloses a milling space 2. Stationary milling cylinders 3 inside milling space 2 roll over a rotating milling bowl 4. The requisite milling pressure is exerted on milling cylinders 3 through a pressure component 5 and through a pressure ring 6 that is common to all the milling cylinders 3.

At the bottom of housing 1 is an annular air box 8 that surrounds a milling-bowl support 7. Air box 8 has a connection 9 for hot air. Air box 8 communicates with milling space 2 through a ring 10 of nozzles. The hot air emerging from ring 10 of nozzles entrains the coal dust generated milling cylinders 3 with it, carries it out through sieves in the top of milling space 2, and conveys it through dust lines to burners, not illustrated, in the combustion space of a boiler.

When the boiler equipment shuts down rapidly as the result of a malfunction, the supply of hot air to air box 8 is suddenly interrupted and the bowl mill shuts down. In this case, the coal dust that happens to be in the milling space 2 at that moment falls down. Most of the coal dust accumulates on milling bowl 4, whereas the smaller and especially finer percentage arrives in air box 8. There is an evacuator 11 in air box 8 to remove the accumulated coal dust. Evacuator 11 has a separate drive mechanism, independent of the mechanism that drives the mill. Evacuator 11 conveys the coal dust to one or more outlet apertures 12 located in the floor of air box 8 and provided with an extraction chute 13.

Evacuator 11 can consist of two concentric rings 14 and 15 connected by means of scrapers 16. Scrapers 16 are oriented at least to some extent radially. At the right side of FIG. 2 the outlet aperture 12 extends over the total radial width of the annular air box 8. In this case, scrapers 16 are preferably radial over their total length.

Figure 2:
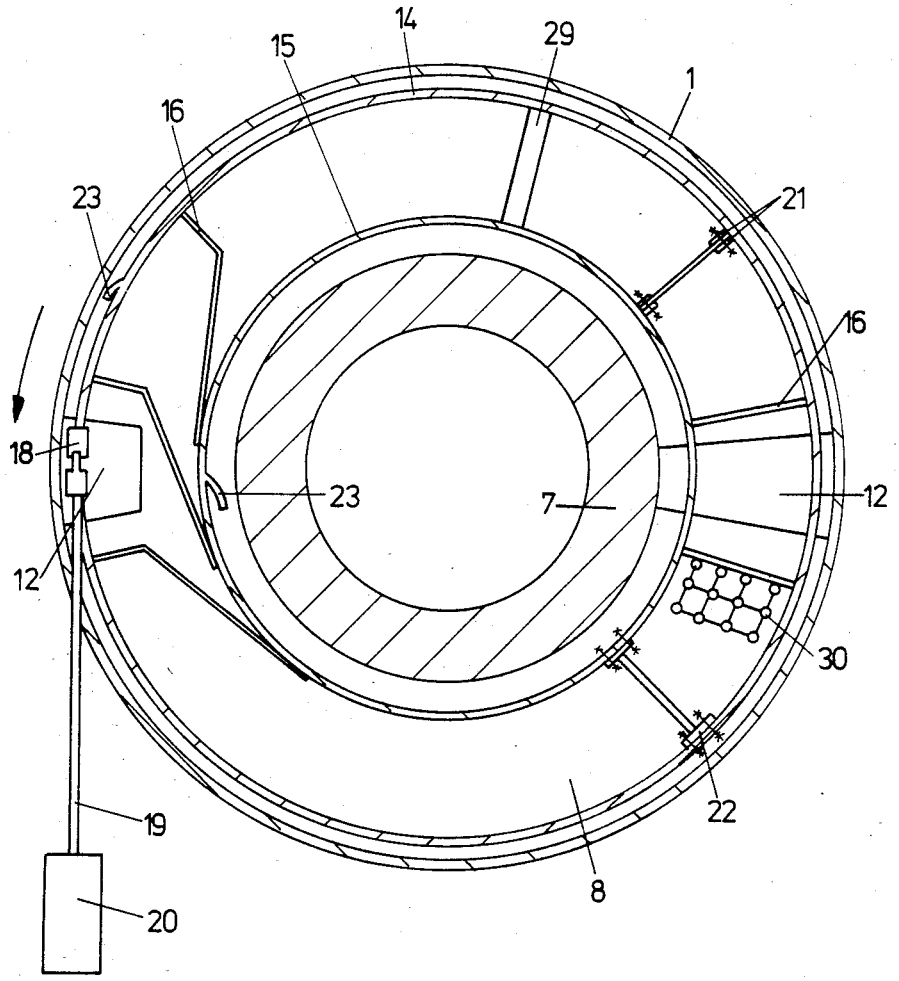
FIG. 2 is a section along the line II-II in FIG. 1.

At the left side of FIG. 2, outlet aperture 12 is positioned radially outward and extends over only part of the radial width of the floor of air box 8. In this embodiment, scrapers 16 are only partly radial, with the length of the radial section of scrapers 16 approximately equal to the radial width of outlet aperture 12. Scrapers 16 are angled over the rest of their length in such a way as to extend at a tangent to inner ring 15 in a direction opposite to that in which evacuator 11 rotates. As evacuator 11 rotates, the material on the inside is advanced outward by the tangential section of scrapers 16 to outlet aperture 12.

Evacuator 11 can be driven by any desired type of mechanism. The mechanism is preferably discontinuous and provided with a detent drive. The upper edge of the outer ring 14 illustrated in FIG. 2 is provided for this purpose with detent teeth 17 that are engaged by a catch pin 18. Catch pin 18 is mounted on a catch 19 that is displaced by a drive mechanism, preferably a hydraulic drive mechanism 20, that travels back and forth. A rack and pinion or crank mechanism for example can also be employed instead of a hydraulic drive mechanism 20. Evacuator 11 preferably rotates more slowly than milling-bowl support 7. Evacuator 11 can be continuously or discontinuously activated whether or not the mill is in operation.

Figure 3:
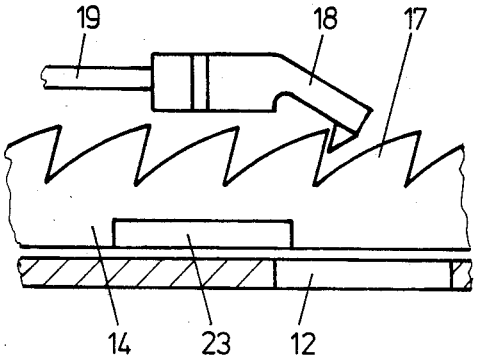
FIG. 3 illustrates a different version of an evacuator ring.

Since catch pin 18 pivots on catch 19, it can drop under its own weight into the gap between two detent teeth 17 and penetrate through any material inside air box 8 up to the level of detent teeth 17. This movement is assisted by the blade-like design of catch pin 18. To prevent catch 19 from getting covered up with powdery material, the catch pin 18 illustrated in FIG. 3 is positioned above one of the outlet apertures 12 in the floor of air box 8. Catch 19 travels over a distance that equals the width of outlet aperture 12. Rings 14 and 15 can consist of connected segments. Scrapers 16 are positioned at the points of contact between the segments are incorporated into the joint. The joint can be produced by welding webs 21 on each side of the point of contact between the segments of rings 14 and 15. Each pair of webs 21 include a scraper 16 between them are secured together with screws. The ends of scrapers 16 can also be welded to iron plates 22 screwed to each side of the points of contact between the segments of rings 14 and 15.

The bottom edge of rings 14 and 15 have one or more apertures that have tongues 23 opposite them. Tongues 23 are bent out parallel to the direction in which evacuator 11 rotates. Material outside rings 14 and 15 in air box 8 will be conveyed in through the apertures in rings 14 and 15 as evacuator 11 rotates and picked up there by scrapers 16.

Above either inner or outer rings 14 and 15, suppressors 24 are attached to stationary parts of the mill. Suppressors 24 prevent evacuator 11 from rising as the result of material accumulated in air box 8.

Figure 4:
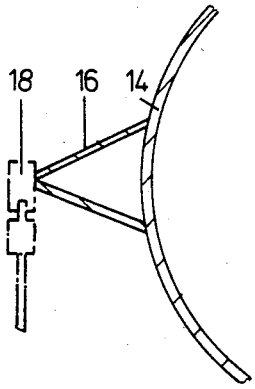
FIGS. 4 and 5 are partial top views of two other versions of an evacuator in accordance with the invention.
Figure 5:
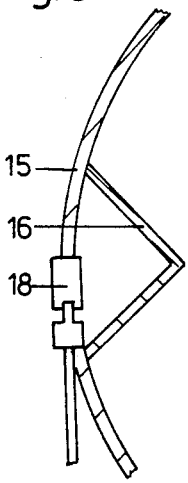
Figure 6:
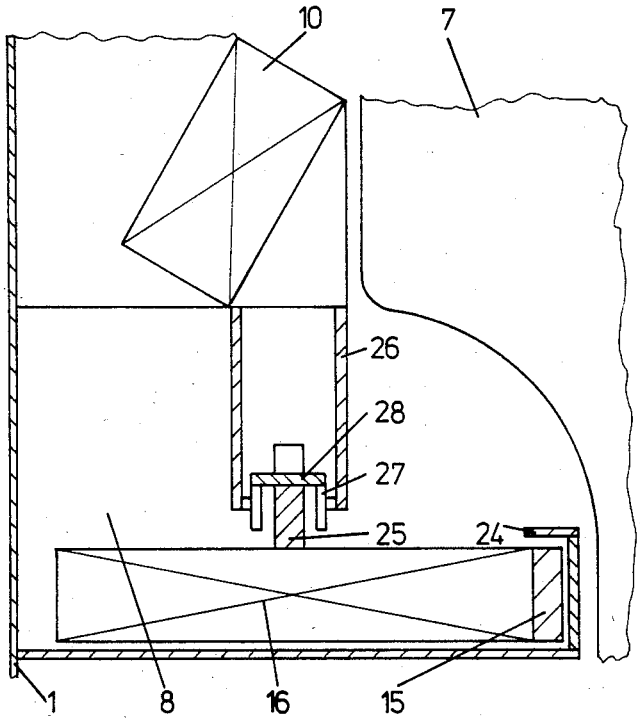
FIG. 6 is a partial longitudinal section through the air box and evacuator of another embodiment of the invention.

As will be evident from FIGS. 4 through 6, evacuator 11 can also have only one ring. In this embodiment the scrapers 16 are at an angle to one another. One end of scrapers 16 is attached either to outer ring 14 or to inner ring 15. The free ends of scrapers 16 are connected. If evacuator 11 has an outer ring 14, the evacuator can have detent teeth 17 like the evacuator composed of two rings. If evacuator 11 has only an inner ring 15, the catch pin 18 in the drive mechanism can engage the free, connected outer ends of scrapers 16. Each type of evacuator 11 can have a ring 25 that has detent teeth 17 and is attached to scrapers 16.

Evacuator 11 can rest on the floor of air box 8. It can also be suspended above the floor from stationary parts of the mill. Such a system is illustrated by way of example in FIG. 6 and involves supporting arms 26. The supporting arms 26 illustrated in FIG. 6 are attached to pressure ring 6 and have rollers 27 at the bottom. Rollers 27 engage the bottom of flanges 28, which are attached to evacuator 11 at ring 25 for example. Rollers 27 can also be mounted on rods that extend into air box 8 through housing 1.

One or more wire brushes 29 are secured between rings 14 and 15 with their bristles touching the floor of air box 8. The function of wire brushes 29 is to pick up any fine material missed by scrapers 16 and transport it to outlet apertures 12. Trailing chains 30 attached to the back of scrapers 16 in relation to the direction that evacuator 11 rotates in will accomplish the same purpose. The individual links of trailing chains 30 are connected radially. The outer links in the last row are also connected to rings 14 and 15. Trailing chains 30 can also be suspended from a support that extends over rings 14 and 15.

The present specification and claims are of course intended solely as illustrative of one or more potential embodiments of the invention and should not be construed as limiting it in any way. The invention may accordingly be adapted and modified in many ways without deviating from the theory behind it or exceeding its scope of application. In particular, any bowl mill with a vertical drive shaft and a hot-air supply located below the milling surface can also be employed instead of the mill described herein.

We claim:

1. A bowl mill with a vertically powered milling bowl having milling cylinders rolling over inside a milling space surrounded by a housing; an annular air box communicating with said milling space below the milling bowl; outlet aperture means in the floor of said air box and evacuator means extending through said air box; said evacuator having separate drive means independent of means for driving the mill; said evacuator means comprising ring means with scraper means; and catch means engaging said scraper means.

2. Bowl mill as defined in claim 1, wherein said evacuator means rotates slower than the milling bowl.

3. Bowl mill as defined in claim 1, wherein said evacuator means comprises two concentric rings with scrapers between said rings.

4. Bowl mill as defined in claim 3, including at least one wire brush touching the floor of said air box and attached to said rings.

5. Bowl mill as defined in claim 3, wherein said rings comprise connected segments and scrapers positioned at points of contact between said segments and included into a joint between said segments.

6. Bowl mill as defined in claim 3, including a collar having detent teeth attached to said scrapers.

7. Bowl mill as defined in claim 3, wherein said scrapers are positioned at least partly radially.

8. Bowl mill as defined in claim 7, wherein a radial section of said scrapers is connected to an outer one of said rings and is approximately as long as an outlet aperture is wide radially, and another section connecting to a radial distance at a tangent to the inner ring.

9. Bowl mill as defined in claim 3, wherein said rings have recesses opening toward a lower edge, tongues bending outward and positioned upstream of each recess with respect to the direction of rotation of said evacuator means.

10. Bowl mill as defined in claim 1, wherein said evacuator means is suspended off the floor of said air box.

11. Bowl mill as defined in claim 1, including at least one suppressor positioned above said evacuator means.

12. Bowl mill as defined in claim 1, wherein said evacuator means comprises a ring and two adjacent scrapers with free ends connected.

13. Bowl mill as defined in claim 1, wherein said evacuator means has trailing chains.

14. Bowl mill as defined in claim 13, wherein said trailing chains are attached to one of said scrapers, said trailing chains having links connected together, outer links of said chains being attached to the rings.

15. Bowl mill as defined in claim 13, wherein said trailing chains are suspended from a support connected to said rings.

16. A bowl mill with and a vertically powered milling bowl having milling cylinders rolling over inside a milling space surrounded by a housing; an annular air box communicating with said milling space below the milling bowl; outlet aperture means in the floor of said air box and evacuator means extending through said air box; said evacuator having separate drive means independent of means for driving the mill; said evacuator means comprising two concentric rings with scrapers between said rings; an upper edge of one ring having detent teeth engaging a catch pin mounted on a catch traveling back and forth.

17. Bowl mill as defined in claim 16, wherein said catch has hydraulic drive means.

18. Bowl mill as defined in claim 16, wherein said catch pin pivots on said catch.

19. Bowl mill as defined in claim 16, wherein said catch pin is positioned above the outlet aperture in the floor of said air box, said catch traveling over a distance that equals the width of said outlet aperture means.

20. A bowl mill with a firing box and a vertically powered milling bowl having milling cylinders rolling over inside a milling space surrounded by a housing; an annular air box communicating with said milling space below the milling bowl; outlet aperture means in the floor of said air box and evacuator means extending through said air box; said evacuator having separate drive means independent of means for driving the mill; said evacuator means comprising a ring and two adjacent scrapers with free ends connected; and a catch pin engaging the free ends of said scrapers.

* * * * *